US012727659B2

(12) United States Patent
Mahoney

(10) Patent No.: US 12,727,659 B2
(45) Date of Patent: Sep. 8, 2026

(54) FLEXIBLE HANDLE FOR MAKEUP APPLICATOR

(71) Applicant: L'OREAL, Paris (FR)

(72) Inventor: Zachary John Mahoney, Freehold, NJ (US)

(73) Assignee: L'Oreal, Paris (FR)

( * ) Notice: Subject to any disclaimer, the term of this patent is extended or adjusted under 35 U.S.C. 154(b) by 629 days.

(21) Appl. No.: 17/412,990

(22) Filed: Aug. 26, 2021

(65) Prior Publication Data

US 2022/0061511 A1 Mar. 3, 2022

Related U.S. Application Data

(60) Provisional application No. 63/071,724, filed on Aug. 28, 2020.

(30) Foreign Application Priority Data

Oct. 22, 2020 (FR) ..... FR2010830

(51) Int. Cl.
*A46B 5/00* (2006.01)
*A46B 9/02* (2006.01)

(52) U.S. Cl.
CPC ..... *A46B 5/0066* (2013.01); *A46B 9/021* (2013.01); *A46B 2200/1053* (2013.01)

(58) Field of Classification Search
CPC ..... A46B 2200/1053; A46B 9/021; A46B 5/0066; A61K 2800/872; A61K 2800/873; B43K 23/04; B43K 23/12; B43K 8/003; A45D 2200/1072; A45D 40/262; A45D 40/265; B34K 23/04; B34K 23/12; B43F 8/003
USPC ..... 401/126, 129; 15/144.1
See application file for complete search history.

(56) References Cited

U.S. PATENT DOCUMENTS

| | | | | |
|---|---|---|---|---|
| 6,292,973 | B1 * | 9/2001 | Moskovich | A46B 5/0054 D4/138 |
| 8,028,707 | B2 | 10/2011 | Wyatt et al. | |
| 2017/0332766 | A1 * | 11/2017 | Caulier | A45D 40/265 |
| 2019/0125506 | A1 * | 5/2019 | Butz | A46B 15/0069 |

FOREIGN PATENT DOCUMENTS

| | | | |
|---|---|---|---|
| FR | 3 027 778 | 5/2016 | |
| WO | WO-2013034638 A1 * | 3/2013 | A45D 40/265 |

* cited by examiner

*Primary Examiner* — Katina N. Henson
(74) *Attorney, Agent, or Firm* — Christensen O'Connor Johnson Kindness PLLC

(57) ABSTRACT

A flexible handle for makeup applicator, in particular a mascara applicator enables a sweeping motion of a mascara brush with just a gesture from the fingertips. An apparatus for applying mascara to eyelashes includes a stem having a longitudinal stem axis with a first end and a second end, an applicator head coupled to the second end of the stem, a flexible handle coupled to the first end of the stem. The flexible handle includes a first part made of a semi-rigid material and a second part made of a flexible material. The flexible handle is of a structure that inhibits twisting while being bent in either of two directions.

13 Claims, 9 Drawing Sheets

FLEXIBLE HANDLE FOR MAKEUP APPLICATOR

CROSS-REFERENCE TO RELATED APPLICATIONS

This application claims the benefit of priority to U.S. provisional application No. 63/071,724 filed Aug. 28, 2020, and French application Serial No. FR 2010830 filed Oct. 22, 2020, the entire contents of which are incorporated herein by reference.

BACKGROUND

Technical Field

The present disclosure is directed to a flexible handle for makeup applicator, and in particular a flexible handle for a mascara applicator.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Conventional mascara applicators include a wand with bristles. The wand includes a stem, with one end of the stem defining an applicator head having the bristles. The applicator head may be a flat comb, a tapered comb, or a curved comb. An applicator head can be thin for shorter lashes, or thick for thicker lashes. Further, an applicator head may have a brush design to promote separation of eyelashes, or another design to promote volume or coverage of eyelashes. The applicator head loaded with mascara is applied to the eyelashes. Mascara application with a conventional applicator requires several brush passes.

An end of the stem of the wand may be attached to a handle. The handle is typically a cone shape or cylinder shape. Rotational stem brushes have been proposed that may reduce the need for a user to roll the handle during application of mascara. A rotating mascara brush may be implemented by supporting a stem of the brush for rotational movement with respect to the handle.

U.S. Pat. No. 8,028,707 to Wyatt et al. describes a cosmetic applicator that includes a handle and a stem, with an applicator head coupled to the stem. An actuator is coupled to the applicator head for moving the applicator head in a vibrational motion.

Despite all of the types of applicator heads, as well as handles that can rotate or vibrate the applicator head, the user is still limited in control of mascara application to up-down, left-right, and twirling motions that require coordinated motion of the whole arm of the user. Using the whole arm in a coordinated motion is difficult to perform with precision, leading to the requirement for multiple brush passes. Coordinated motion of the whole arm is especially challenging for elderly persons, or persons with arthritis or other conditions that have joint issues.

It is one object of the present disclosure to describe a flexible handle for a makeup applicator and method of applying makeup using wrist gestures that allow finer control of makeup application without the person having to move their entire arm.

SUMMARY

An aspect is an apparatus for applying mascara to eyelashes, that can include a stem having a longitudinal stem axis with a first end and a second end; an applicator head coupled to the second end of the stem; a flexible handle coupled to the first end of the stem, in which the flexible handle includes a first part made of a semi-rigid material and a second part made of a flexible material, and in which the flexible handle is of a structure that inhibits twisting while being bent in either of two directions.

An aspect is a flexible handle for a makeup applicator, that can include a first part made of a semi-rigid material; a second part made of a flexible material; and a base at a junction of the first part and the second part, the flexible handle being detachably coupled to the makeup applicator, in which the second part of the flexible material and the first part of the semi-rigid material are integral and of a structure that prevents twisting of the flexible handle while bending in either of two directions.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
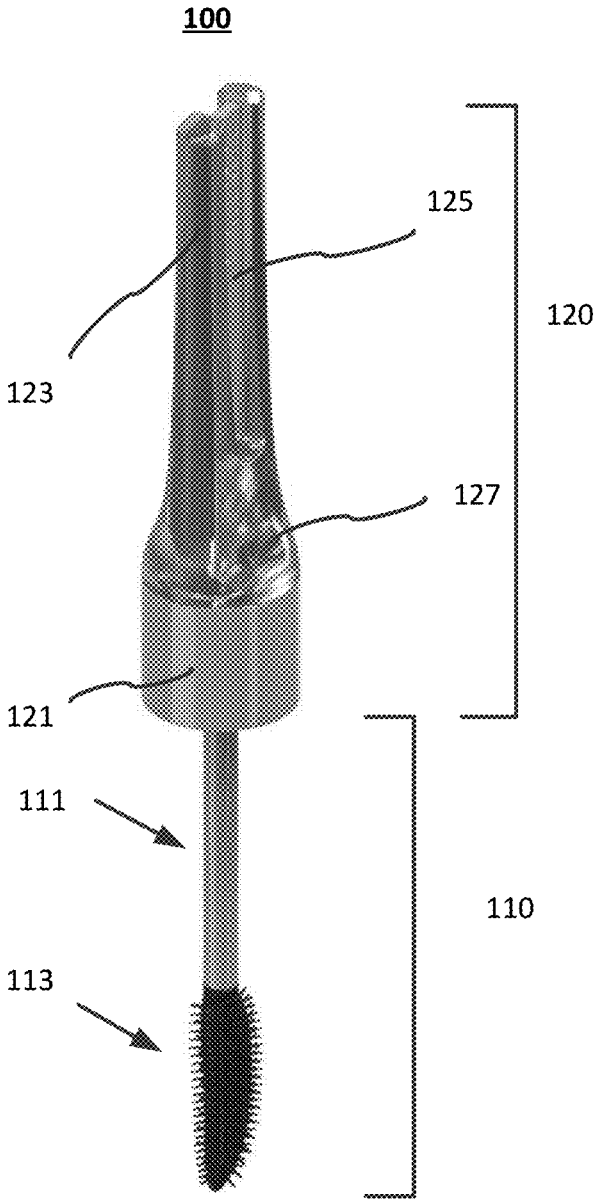
FIGS. 1A, 1B, 1C are schematics illustrating a makeup applicator and a range of flexing motions of a handle for a makeup applicator in accordance with an exemplary aspect of the disclosure.

In the drawings, like reference numerals designate identical or corresponding parts throughout the several views. Further, as used herein, the words "a," "an" and the like generally carry a meaning of "one or more," unless stated otherwise. The drawings are generally drawn to scale unless specified otherwise or illustrating schematic structures or flowcharts.

Furthermore, the terms "approximately," "approximate," "about," and similar terms generally refer to ranges that include the identified value within a margin of 20%, 10%, or preferably 5%, and any values therebetween.

Aspects of this disclosure are directed to inflexible handle for a makeup applicator, such as a mascara applicator.

In order to provide control of makeup application, a flexible handle that can be curled into a hook shape is provided. In one aspect, the makeup applicator is constructed as a one piece bi-injected cap and stem that is flexible where the consumer holds the cap stem. This allows the consumer to flex the cap stem to assist with the sweeping motion of the cosmetic applications. Cosmetics that may be contemplated include, but are not limited to, lip gloss, liner and/or lipstick, concealer, foundation, eye liner, eye shadows, and/or mascara. The makeup applicator allows the consumer to manipulate the sweeping motion of the mascara brush with a gesture of the fingertips. A bi-injected stem/cap is preferably utilized having one part composed of a semi-rigid material (such as polypropylene (PP)) and another part composed of a flexible material (for example, hytrel or other flexible material).

Figure 1B:
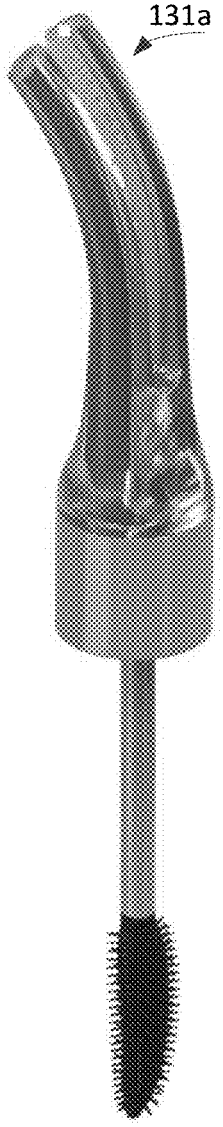
Figure 1C:
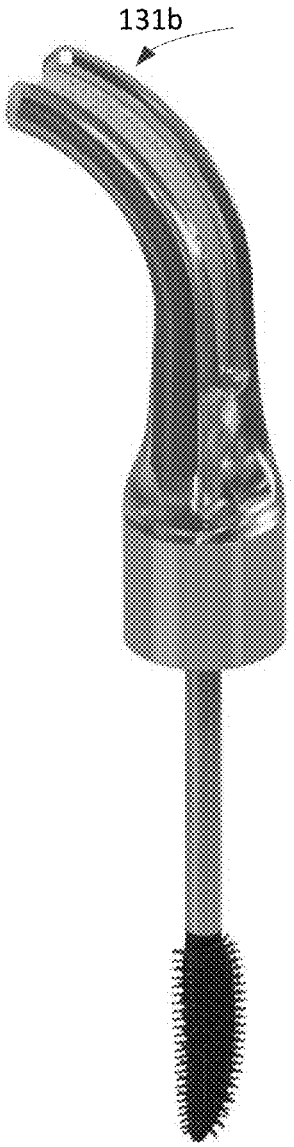

FIGS. 1A, 1B, 1C are schematics illustrating a makeup applicator and a range of flexing motions of a handle for a makeup applicator in accordance with an exemplary aspect of the disclosure. Regarding FIG. 1A, the makeup applicator 100 may include a makeup wand 110 and a flexible handle 120 attached to the wand. The wand 110 may be detachably attached to the flexible handle 120 so that different types of wands can be attached. The connection between the makeup wand and the flexible handle may be by way of inserting the stem 111 by friction fit into an opening in a cap portion 121, where the opening has substantially a same shape as the inserted portion of stem 111. The wand 110 may be a conventional mascara wand with a brush 113. The wand 110 is interchangeable with other types of wands.

In some embodiments, the cap portion 121 may include a motor to rotate and/or vibrate the wand 110.

Figure 2:
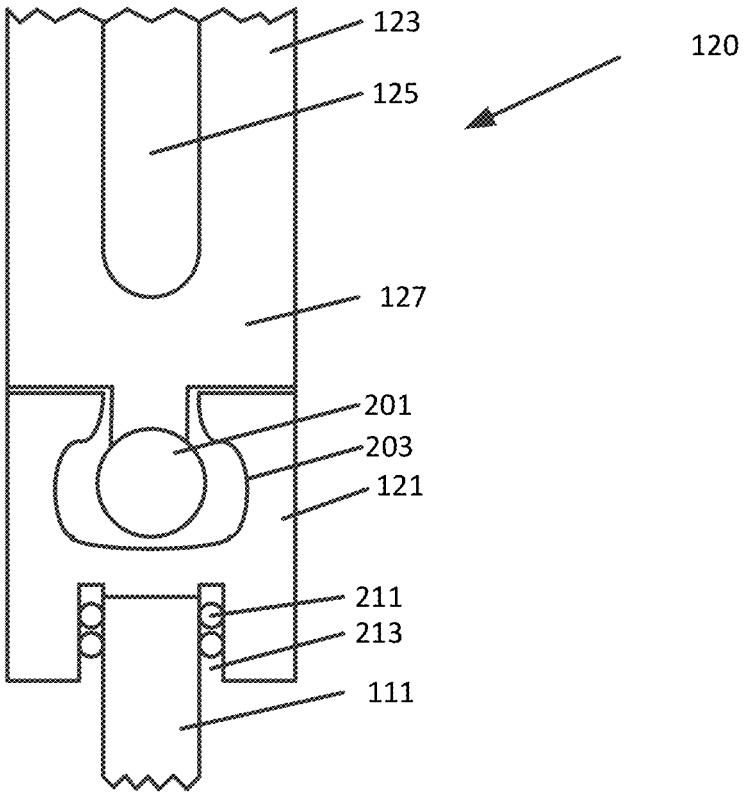
FIG. 2 is a cut-out view of the connection section for an applicator and handle in accordance with an exemplary aspect of the disclosure.

FIG. 2 is a cut-out view of the connection section for a makeup applicator and handle in accordance with an exemplary aspect of the disclosure. In some embodiments, an opening 213 in the cap portion 121 may include spring-loaded wheels or balls 211 around the circumference of the opening 213 to provide a tight grip on the stem 111.

In some embodiments, the cap portion 121 may be a separate connector that is connected to the handle 120. The handle 120 may include a protrusion 201 that may be compression fitted into a cavity 203 in an end of the cap portion 121. The protrusion 201 may be an extension at an end of the handle 120. In some embodiments, the cavity 203 may have an elongated or oval shaped opening and the protrusion 201 may be of comparable elongated or oval shape with a length and a width such that the length of the protrusion 201 corresponds to the longer dimension of the elongated or oval shaped opening of the cavity 203. to the elongated or oval shapes serve to prevent the handle from being rotated in the cap 121.

In some embodiments, the cap portion 121 may be an integral part of the handle 120, which would eliminate the need to a cavity and a protrusion. In addition, it should be understood that an alternative embodiment may include a reversed structure in which the cap portion 121 includes the protrusion that may be inserted into a cavity of the base 127.

Figure 3:
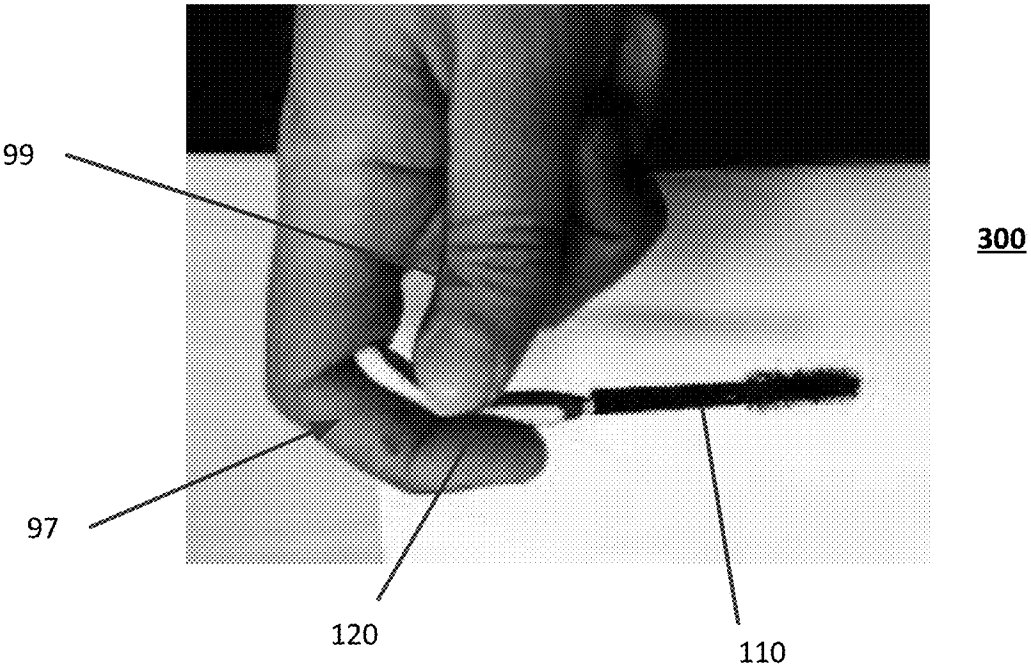
FIG. 3 is a perspective view of a way of holding the handle for a makeup applicator for performing a wrist gesture in accordance with an exemplary aspect of the disclosure.

The flexible handle 120 is configured to flex in a manner to assist a user with a sweeping motion of the makeup applicator. The sweeping motion of the makeup applicator may be accomplished with a gesture by a finger against the thumb while grasping the handle with the fingertips. Regarding FIG. 3, the flexible handle 120 is configured to flex into a hook using increasing force by curling a finger 97 against a thumb 99.

In one embodiment, the configuration of the flexible handle 120 to flex into a hook includes at least two bars or rod-shaped components of flexible material 123 positioned to flank opposite sides of a flat rectangular sheet of semi-rigid material 125 in order to substantially inhibit or prevent twisting of the handle 120 while it is being bent in either of two directions that are perpendicular to the plane of a surface of the flat rectangular sheet. A base 127 of the handle may be formed of the same flexible material 123 as the at least two bars/rods and thereby constitute a section where the at least two bars/rods join together.

FIG. 1B shows a slight bend 131*a*. FIG. 1C shows a hook-shaped bend 131*b*. In this configuration the flexible handle 120 can bend to approximately 45 degrees into the hook-shaped bend without twisting with light force made by curling a finger about a supporting thumb (see FIG. 3).

Figure 4A:
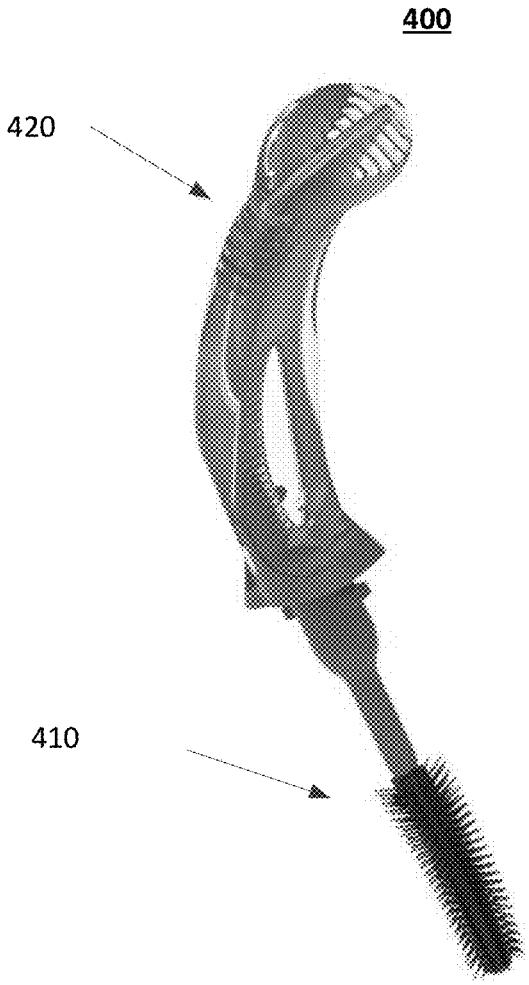
FIGS. 4A, 4B, 4C are schematics illustrating views of an alternative design of a handle and makeup applicator in accordance with an exemplary aspect of the disclosure.
Figure 4B:
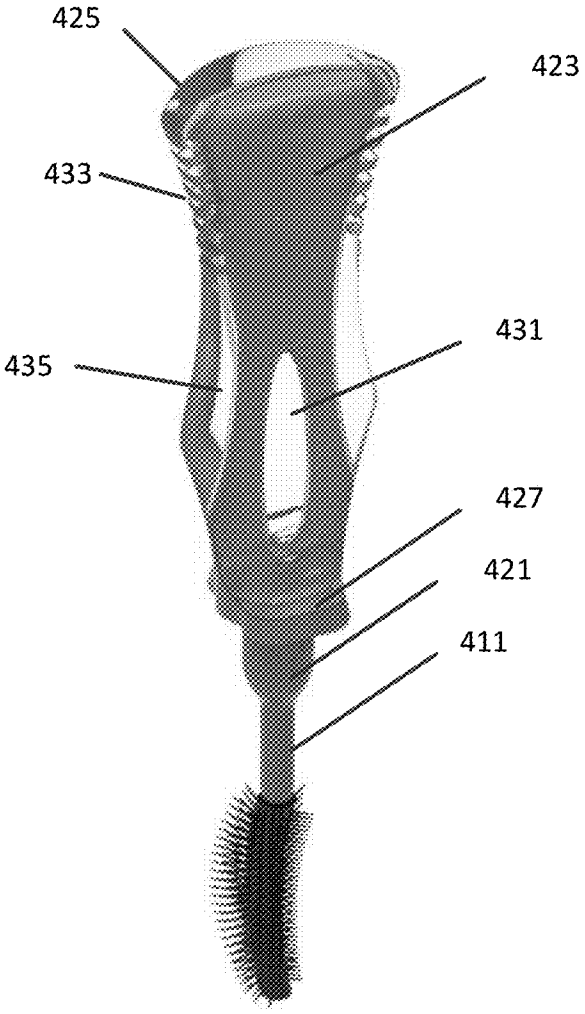
Figure 4C:
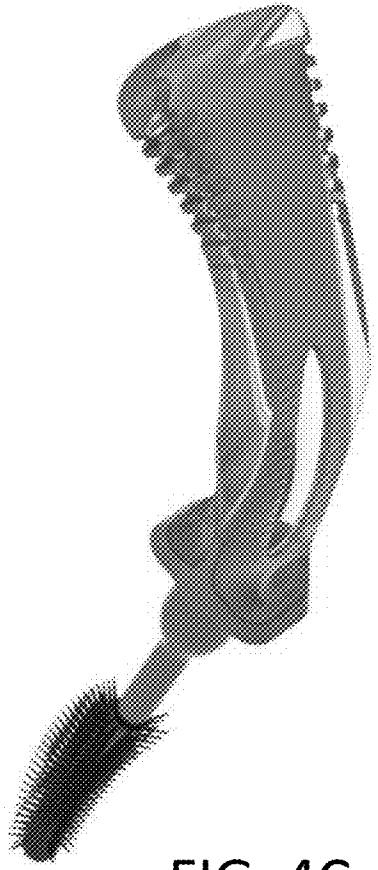

FIGS. 4A, 4B, 4C are schematics illustrating views of an alternative design of a handle and makeup applicator in accordance with an exemplary aspect of the disclosure. The handle 420, attached to the makeup wand 410, includes a pattern of flexible material 423 with a perforated or slotted backing component of semi-rigid material 425. In some embodiments, the flexible material 423 is formed with ridges or bumps to improve grip, by preventing slippage of a finger.

Figure 5:
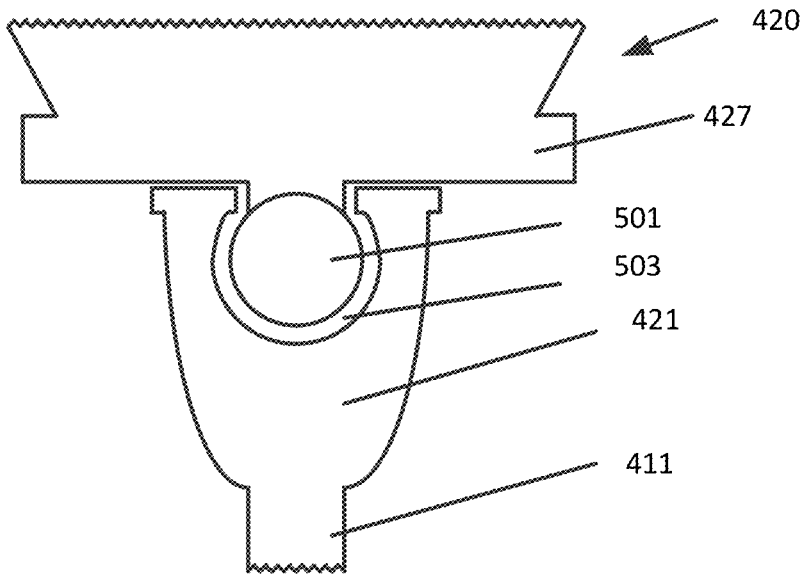
FIG. 5 is a cut-out view of a connection section for the alternative design of the handle and makeup applicator in accordance with an exemplary aspect of the disclosure.

FIG. 5 is a cut-out view of a connection section for the alternative design of the handle and makeup applicator in accordance with an exemplary aspect of the disclosure. In a similar manner as in FIG. 2 above, a cap portion 421 may be connected to the handle 420. A protrusion 501 of the handle 420 may be compression fitted into a cavity 503 in an end of the cap portion 421. Alternatively, the cap portion 421 may be an integral part of the makeup applicator stem 411. The cavity 503 may have an opening that is elongated or oval shaped and the protrusion 501 of the handle 420 may have a comparable elongated or oval shape with a length and a width, in which the length of the protrusion 501 corresponds to the length dimension of the elongated or oval shaped opening in order to prevent the handle from being rotated relative to the stem 411.

In an alternative embodiment, a reversed structure of the connection section may be one in which the cap portion 421 includes the protrusion that is fit into a cavity of the base 427.

Manufacturing

Various types of molding processes may be used to mold a component of flexible material to a component of semi-rigid material. Overmolding is an injection molding process where a flexible material is molded onto a rigid plastic by using heat and pressure along with liquid silicone. In some embodiments, a rectangular shaped component (e.g., flat sheet 125) of semi-rigid material is placed into a mold. The mold takes the shape of the two rods to be formed on opposite edges of the rectangular shaped component. After the rectangular shaped component is placed in the mold, the flexible material (e.g., 123) is injected into the mold at sufficient heat to melt the surface of the rectangular component to achieve chemical bonding.

In some embodiments, the rectangular shaped component includes an integral cylindrical portion (e.g., 121) at one end of the rectangular shaped component. Again, the mold takes the shape of the two rods to be formed on opposite edges of the rectangular shaped component as well as the cylindrical portion.

In some embodiments, as in FIG. 4B, a semi-rigid material or a flexible material is formed in an elongated pattern (e.g., 423) having an oval-shaped opening (e.g., 431) in the vicinity of an end to be connected to a makeup applicator to allow slight bending up to about 35 degrees (see FIG. 4C). A rigid material (e.g., 425) may be formed of an elongated pattern with a fishbone-like or rib-like pattern (e.g., 433) in the vicinity of an end away from a makeup applicator, and an elongated opening 435 over a majority of the pattern in the vicinity of the applicator connection end. The applicator connection end of the rigid material is of a design that is complementary to a comparable end of the flexible material. The complementary design of the other end of the rigid material and the comparable end of the flexible material enable locking of the rigid material to the flexible material (i.e., a snap-fit). Also, the elongated pattern with fishbone-like or rib-like pattern 433 is configured to clamp around an end of the flexible material as a support structure.

Materials

In some embodiments, both the semi-rigid material and the flexible material may be thermoplastic resins. It is preferred that the semi-rigid material is polypropylene and the flexible material is a thermoplastic elastomer (TPE). In one embodiment, the semi-rigid material is a polypropylene with an added elastic element to give it the semi-rigid characteristic. In one embodiment, the flexible material is DuPont Hytrel thermoplastic elastomer that combines the flexibility of rubber with the strength and processability of thermoplastics. In some embodiments, the semi-rigid material and the flexible material may be of different colors.

Numerous modifications and variations of the present invention are possible in light of the above teachings. Although the disclosure describes an applicator for mascara as a suitable application, the flexible handle may be used for other types of makeup, such as lip gloss, eye shadow, and nail polish.

In addition, because the flexible handle utilizes finger motion and some wrist motion rather than movement of the whole arm, older people or persons with joint issues such as arthritis may find the flexible handle much less painful and easier to use.

Furthermore, the flexible handle itself may be modified to include bristles at the end of one side such that the flexible handle itself may be a makeup applicator, such as for applying foundation, concealer, or use as a blending tool.

It is therefore to be understood that within the scope of the appended claims, the invention may be practiced otherwise than as specifically described herein.

The invention claimed is:

1. An apparatus for applying mascara to eyelashes, the apparatus comprising:

a stem having a longitudinal stem axis with a first end and a second end;

an applicator head coupled to the second end of the stem; and a flexible handle coupled to the first end of the stem, wherein the handle includes a first end and a second end, a cap portion at the second end of the handle couples the first end of the stem to the handle, the flexible handle including:

a first part made of a flat rectangular sheet of semi-rigid material; and a second part having first and second rod-shaped portions made of a flexible material, the first and second rod-shaped portions being disposed on opposite edges of the rectangular sheet and extending in a direction of the longitudinal stem axis, wherein the flexible handle is of a structure that inhibits twisting while being bent in either of two directions, an exterior of the sheet being exposed between the first and the second rod-shaped portions and throughout a majority of a length of the sheet, the handle being flexible throughout the majority of the length of the sheet, wherein the flexible handle has a length configured for resting the first end of the handle against a palm-side of a finger and the second end of the handle against a fingertip, and the flexible handle has a flexibility to flex into a hook when a force is applied at about a middle of the length of the handle.

2. The apparatus of claim 1, wherein the second part further includes a base extending between the first and second rod-shaped components.

3. The apparatus of claim 1, wherein the cap portion is in integral part of the flexible handle.

4. The apparatus of claim 1, wherein the cap portion includes an opening that is a circumference of the stem, and wherein the opening is configured to detachably hold the stem by a compression fit.

5. The apparatus of claim 1, wherein the cap portion includes a connection cavity for connecting the flexible handle to the cap.

6. The apparatus of claim 1, wherein the semi-rigid material is polypropylene.

7. The apparatus of claim 1, wherein the flexible material is a thermoplastic elastomer.

8. The apparatus of claim 7, wherein the thermoplastic elastomer is a material that combines flexibility of rubber with strength of thermoplastic.

9. The apparatus of claim 1, wherein the first part of the semi-rigid material includes a chemical bond to the second part of the flexible material to give a structure that prevents twisting of the flexible handle while bending in either of two directions, wherein the chemical bond is formed from a melt of the semi-rigid material.

10. The apparatus of claim 9, further comprising the cap portion mounted to the base, wherein the cap portion includes an opening for detachably holding the makeup applicator.

11. The apparatus of claim 1, wherein the length of the handle is about three times a greatest width of the handle.

12. An apparatus for applying mascara to eyelashes, comprising:

a stem having a longitudinal stem axis with a first end and a second end;

an applicator head coupled to the second end of the stem; and a flexible handle coupled to the first end of the stem, wherein the handle includes a first end and a second end, a cap portion at the second end of the handle couples the first end of the stem to the handle, the flexible handle including:

a first part made of a semi-rigid or flexible material formed in an elongate pattern having an oval-shaped opening in the vicinity of an end to be connected to the makeup applicator; and a second part made of a rigid material formed in an exposed elongated pattern with a fishbone or rib pattern proximate to an end away from a makeup applicator and an elongated opening over a majority of the pattern proximate to the applicator connection end, wherein the flexible handle is of a structure that inhibits twisting while being bent in either of two directions, and wherein the flexible handle has a length configured for resting the first end of the handle against a palm-side of a finger and the second end of the handle against a fingertip, and the flexible handle has a flexibility to flex into a hook when a force is applied at about a middle of the length of the handle.

13. The apparatus of claim 12, wherein the length of the handle is about three times a greatest width of the handle.

* * * * *